US010919687B2

(12) United States Patent
Schroer et al.

(10) Patent No.: US 10,919,687 B2
(45) Date of Patent: Feb. 16, 2021

(54) DISPENSER WITH CAP

(71) Applicant: DDP SPECIALTY ELECTRONIC MATERIALS US, LLC, Wilmington, DE (US)

(72) Inventors: Daniel R. Schroer, Midland, MI (US); Marc S. Black, Midland, MI (US); Chad V. Schuette, Midland, MI (US); Christopher J. Siler, Midland, MI (US)

(73) Assignee: DDP SPECIALTY ELECTRONIC MATERIALS US, LLC, Wilmington, DE (US)

( * ) Notice: Subject to any disclaimer, the term of this patent is extended or adjusted under 35 U.S.C. 154(b) by 0 days.

(21) Appl. No.: 16/343,039

(22) PCT Filed: Oct. 16, 2017

(86) PCT No.: PCT/US2017/056737

§ 371 (c)(1),
(2) Date: Apr. 18, 2019

(87) PCT Pub. No.: WO2018/075381

PCT Pub. Date: Apr. 26, 2018

(65) Prior Publication Data

US 2020/0047980 A1 Feb. 13, 2020

Related U.S. Application Data

(60) Provisional application No. 62/410,408, filed on Oct. 20, 2016.

(51) Int. Cl.
*B65D 83/20* (2006.01)
*B65D 83/30* (2006.01)
(Continued)

(52) U.S. Cl.
CPC ..... *B65D 83/201* (2013.01); *B65D 83/207* (2013.01); *B65D 83/303* (2013.01); *B65D 83/345* (2013.01); *B65D 83/46* (2013.01)

(58) Field of Classification Search
CPC .... B65D 83/46; B65D 83/201; B65D 83/207; B65D 83/303; B65D 83/345
(Continued)

(56) References Cited

U.S. PATENT DOCUMENTS 3,361,301 A * 1/1968 Meshberg ..... B65D 83/205 222/149
3,506,165 A * 4/1970 Beard ..... B65D 83/46 222/402.22
(Continued)

FOREIGN PATENT DOCUMENTS

DE 102009018528 A1 11/2010
EP 2977333 A1 1/2016
JP 5538714 U 3/1980

OTHER PUBLICATIONS

International Search Report/Written Opinion, dated Jan. 9, 2918, corresponding to International Application No. PCT/US17/56737, filed on Oct. 16, 2017.

*Primary Examiner* — Paul R Durand
*Assistant Examiner* — Andrew P Bainbridge

(57) ABSTRACT

An article has a can with a valve stem and a dispensing device, the dispensing device includes a cap over the valve stem, a hollow tube extending through a slot in the cap and attached to the valve stem, a sleeve slidably extending over the hollow tube, a lever hingedly attached to the cap and operatively engaging the sleeve, an elastic feature that provides a force or causes a force to be applied to the sleeve in a direction that tries to move the sleeve to a closed position, and a sealing gasket between the sleeve and hollow tube proximate to the exit end of the hollow tube; where the
(Continued)

sleeve seals the hollow tube when in the closed position and displacing the lever towards the can simultaneously unseals the hollow tube and tilts the valve stem, and when released allows the sleeve to restore to a closed position.

8 Claims, 3 Drawing Sheets

(51) Int. Cl.
*B65D 83/34* (2006.01)
*B65D 83/46* (2006.01)

(58) Field of Classification Search
USPC ..... 222/402.11, 402.15
See application file for complete search history.

(56) References Cited

U.S. PATENT DOCUMENTS 3,777,947 A * 12/1973 Klema ..... B65D 83/207 222/402.23
4,179,052 A * 12/1979 Abbott ..... B65D 47/243 222/509
5,370,313 A * 12/1994 Beard ..... B65D 47/243 239/337
5,605,257 A * 2/1997 Beard ..... B05B 11/0072 222/189.09
6,202,899 B1 * 3/2001 Lasserre ..... B05B 11/0005 222/402.1
6,234,363 B1 * 5/2001 Stradella ..... B65D 47/2037 222/148
6,474,510 B2 * 11/2002 Frutin ..... B65D 83/201 222/153.11
6,494,349 B1 * 12/2002 Thompson ..... B65D 83/206 222/310
6,827,239 B2 * 12/2004 Lasserre ..... B65D 83/46 222/153.11
7,891,529 B2 * 2/2011 Paas ..... B65D 83/384 222/1
8,096,450 B2 * 1/2012 Herry ..... B05B 11/3014 222/402.11
9,010,572 B2 * 4/2015 Demey ..... B05B 1/3073 222/23
2007/0090133 A1 * 4/2007 Macleod ..... B65D 83/753 222/402.13
2018/0354708 A1 * 12/2018 Schroer ..... B65D 83/345

* cited by examiner

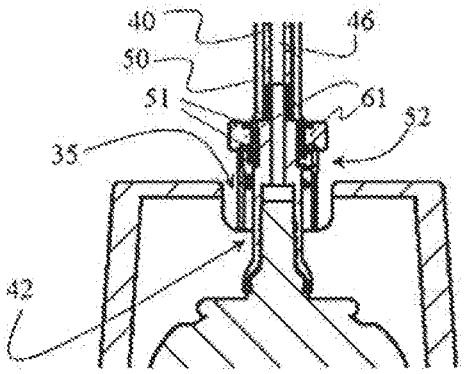
FIG. 2D
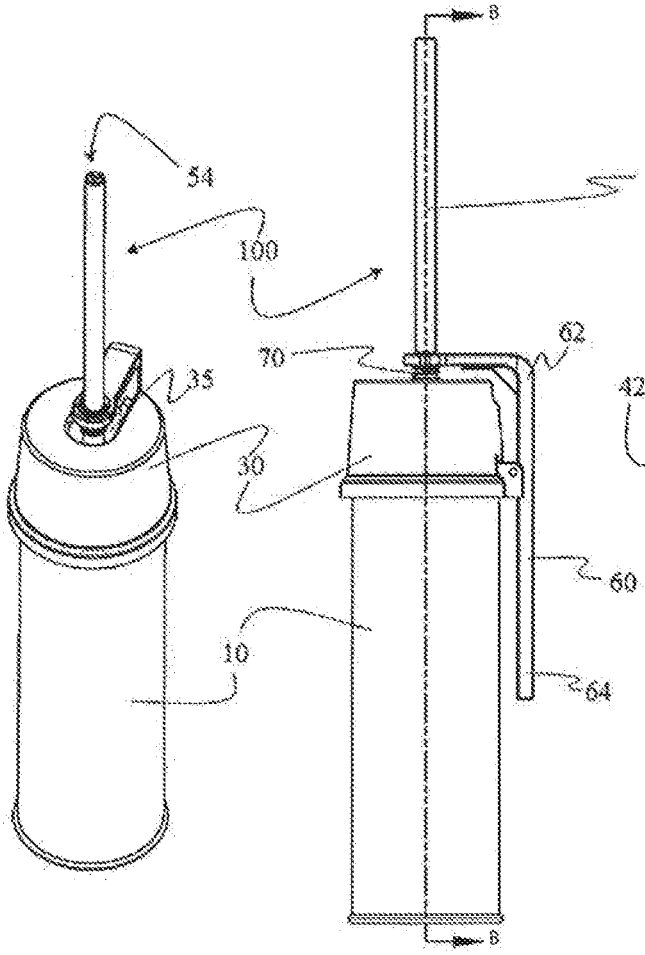
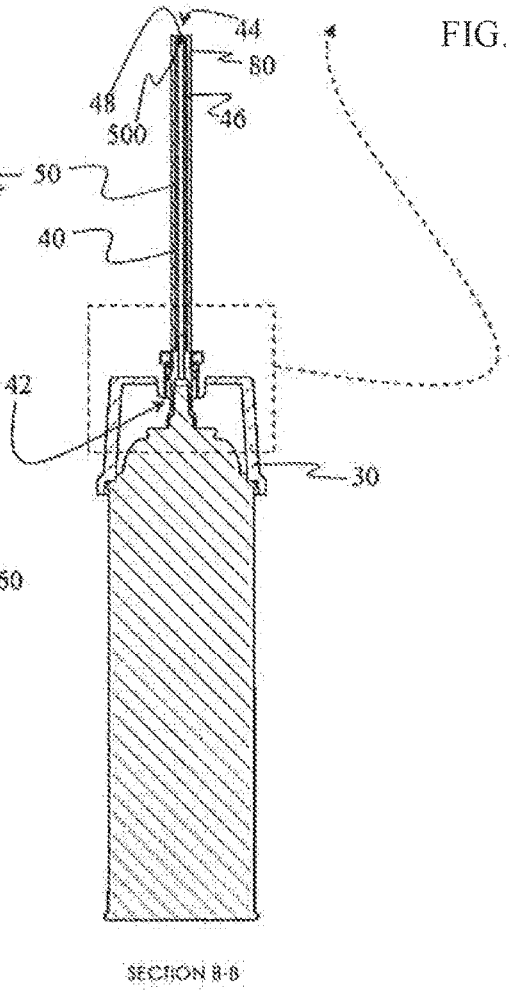
FIG. 2A FIG. 2B FIG. 2C

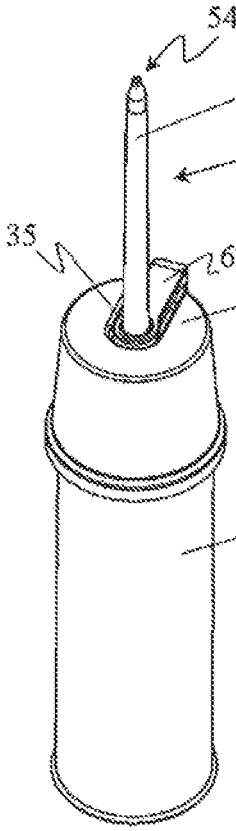
FIG. 3A
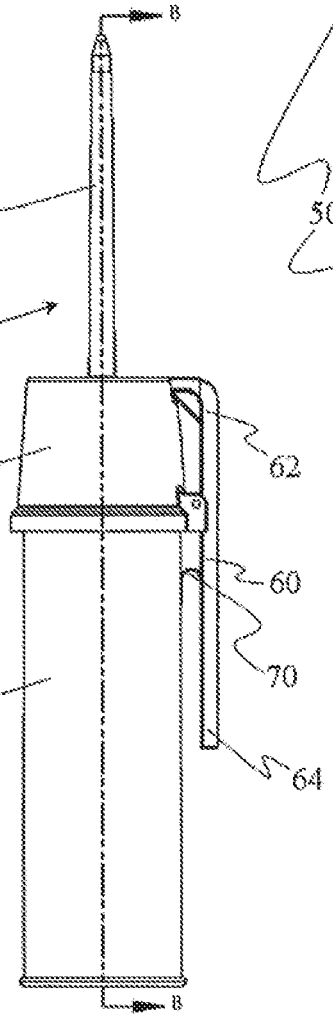
FIG. 3B
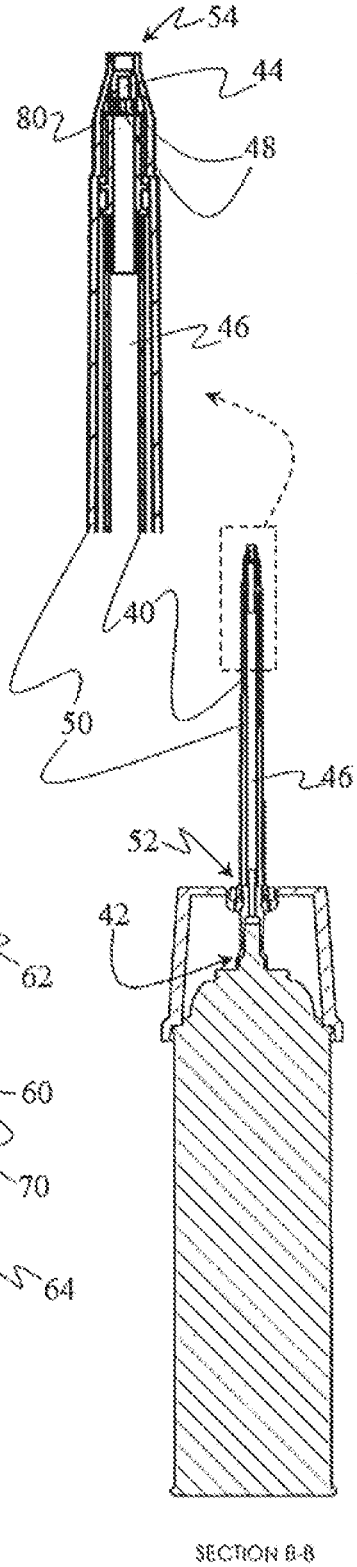
FIG. 3D
FIG. 3C

DISPENSER WITH CAP

BACKGROUND OF THE INVENTION

Field of the Invention

The present invention relates to an article comprising a can and a dispensing device attached to the can.

Introduction

Numerous products are available in pressurized cans for dispensing by a consumer. Such products include food items such as whipped toppings and frosting, as well as building materials such as spray foam sealants. Dispensing devices for such pressurized cans range from simple tubes attached to or part of a valve stem of the can to elaborate trigger activated devices. Despite a multitude of dispensing devices presently available, there is a need to develop a dispensing device that provides a combination of desirable features and/or capabilities.

One area in need of improvement is in the field of ergonomics. Often, dispensing requires holding the container near its top with one's wrist bent at an angle relative to the forearm. Holding the container near its top causes the majority of the container's weight to be below one's hand causing excessive torque on the wrist when bending the wrist to change dispensing angles. Moreover, the mere fact that the wrist must be bent to hold a container and dispense contents from the container means the wrist is strained from its neutral position in line with the forearm in order to dispense container contents. It is desirable to discover a dispensing means for contents of a compressed container that allows holding the container at its center of balance and with one's wrist in a neutral position to avoid wrist strain.

Another area in need of improvement is in reducing the steps necessary to dispense contents of a compressed container after purchasing or storing the container. Pressurized containers are typically shipped and stored with a cap over a valve stem of the container. The cap protects the valve stem from accidentally being bumped causing container contents to expel from the can. A user typically must remove the cap in order to access the valve stem to dispense the contents of the container. It is desirable to identify a way to leave the cap in place such that the cap protects the valve stem of the container during shipping and storage but at the same time allows access to the valve stem for dispensing purposes without requiring removal of the cap.

Additionally, it is desirable to seal the dispensing tube when not dispensing contents from a can so as to prevent dripping from the dispenser. Even more desirable is a dispenser that with a single action and with a single hand can both open a can and dispenser to dispense contents from the can and then with a single action of a single hand both close the can and seal the dispensing tube of the dispenser. Hence, unsealing a dispensing device and dispensing can contents as well as sealing off the dispensing tube when done dispensing can contents are tied together in single actions.

It is desirable to provide a dispensing device that allows a user to hold and operate a can and dispenser with one hand by holding the can near the can's center of gravity and, in an axial direction with respect to the forearm of the hand, to allow access to difficult to reach locations, those locations that require a long reach to access and to make dispensing more comfortable and less fatiguing to a user. At the same time, it is desirable for the dispensing device to be compact and easily packaged with a pressurized can. It is further desirable for the dispensing device to provide a user the ability to start and stop dispensing from the pressurized can with a single hand and that automatically seals the dispenser and thereby prevents dripping when in the closed position. It is desirable for the dispensing device to be operational regardless of orientation.

BRIEF SUMMARY OF THE INVENTION

The present invention offers a dispensing device that allows a user to leave the cap on the can when dispensing from it thereby obviating a need to remove the cap to attach a dispensing device to the valve stem of the can yet providing a cap that protects the valve stem of the can during shipping, storage and use of the can. The present invention further provides a dispensing device that allows a user to hold and operate a can with one hand near the can's center of gravity and, in an axial direction with respect to the forearm of the hand, to allow access to difficult to reach locations, those locations that require a long reach to access and to make dispensing more comfortable and less fatiguing to a user. At the same time, the dispensing device is compact and easily packaged with a pressurized can, provides a user the ability to start and stop dispensing from the pressurized can with a single hand and that automatically seals the dispenser and prevents dripping when in the closed position, and is operational regardless of orientation.

In a first aspect, the present invention is an article comprising a can (10) and a dispensing device (100) wherein the can has opposing top (12) and bottom (14) ends with a valve stem (20) extending out from the top end and wherein the dispensing device comprises: (a) a cap (30) attached to the can and that fits over the top end of the can and covers the valve stem where the cap has defined therein an access slot (35) that provides access to the valve stem; (b) a hollow tube (40) having opposing entrance (42) and exit (44) ends and that defines a hollow tube flow channel (46) extending through the hollow tube including the entrance end and one or more than one hole (48) proximate to the exit end, the entrance end of the hollow tube being removably attached to the valve stem of the can so that there is fluid communication through the valve stem into the flow channel and the hollow tube extending through the access slot in the cap; (c) a sleeve (50) extending over a portion of the hollow tube, the sleeve having a lower end (52) and an opposing dispensing end (54) that is proximate to the exit end of the hollow tube where the sleeve defines a hole proximate to the dispensing end and the sleeve is capable of reversibly sliding over the hollow tube; (d) a lever (60) that has a sleeve end (62) and an opposing trigger end (64) that is hingedly attached to the cap between the sleeve and trigger ends, where the sleeve end is operatively engaged with the sleeve so as to cause the sleeve to move towards the exit end of the hollow tube and tilt the valve stem of the can when the trigger end of the lever is displaced towards the can and where the trigger end extends along at least a portion of the length of the can; (e) an elastic feature (70) that provides a force, or causes a force to be applied, to the sleeve when the sleeve is moved towards the exit end of the hollow tube, the force being in a direction that tries to move the sleeve towards the entrance end of the hollow tube; and (f) a sealing gasket (80) around the outside of the hollow tube between the hollow tube and the sleeve and located between the exit and entrance ends of the hollow tube, the sealing gasket preventing fluid communication past the sealing gasket between the hollow tube and sleeve; wherein, when the sleeve is in the closed position the sleeve seals the hole proximate to the exit end of the hollow tube so as to preclude fluid flow out from the flow channel of the hollow tube proximate to the exit end of the hollow tube and the trigger end of the lever extends next to but spaced apart from the can but when the sleeve is in the open position the sleeve is displaced towards the exit end of the hollow tube unsealing the hole proximate to the exit end of the hollow tube thereby allowing fluid flow from the flow channel of the hollow tube through the hole proximate to the exit end of the hollow tube; and wherein with a single action of pressing the lever so as to displace the trigger end of the lever towards the can when the sleeve is in a closed position causes the sleeve to move into an open position and the valve stem to tilt thereby opening the can and with a single action of releasing pressure on the trigger end of the lever the sleeve moves into a closed position sealing the hollow tube and the valve stem returns to a non-tilted position closing the can.

The present invention is useful for dispensing contents from pressurized cans having a valve stem extending from an end of the can.

BRIEF DESCRIPTION OF THE DRAWINGS

FIG. 2. An illustration of an article of the present invention. (a) illustrates a perspective view; (b) illustrates a side view; (c) illustrates a cut-away view along viewing line B of (b); and (d) is a blown up illustration of a portion of illustration (c).

FIG. 3. An illustration of an article of the present invention. (a) illustrates a perspective view; (b) illustrates a side view; (c) illustrates a cut-away view along viewing line B of (b); and (d) is a blown up illustration of a portion of illustration (c).

DETAILED DESCRIPTION OF THE INVENTION

Figure 1:
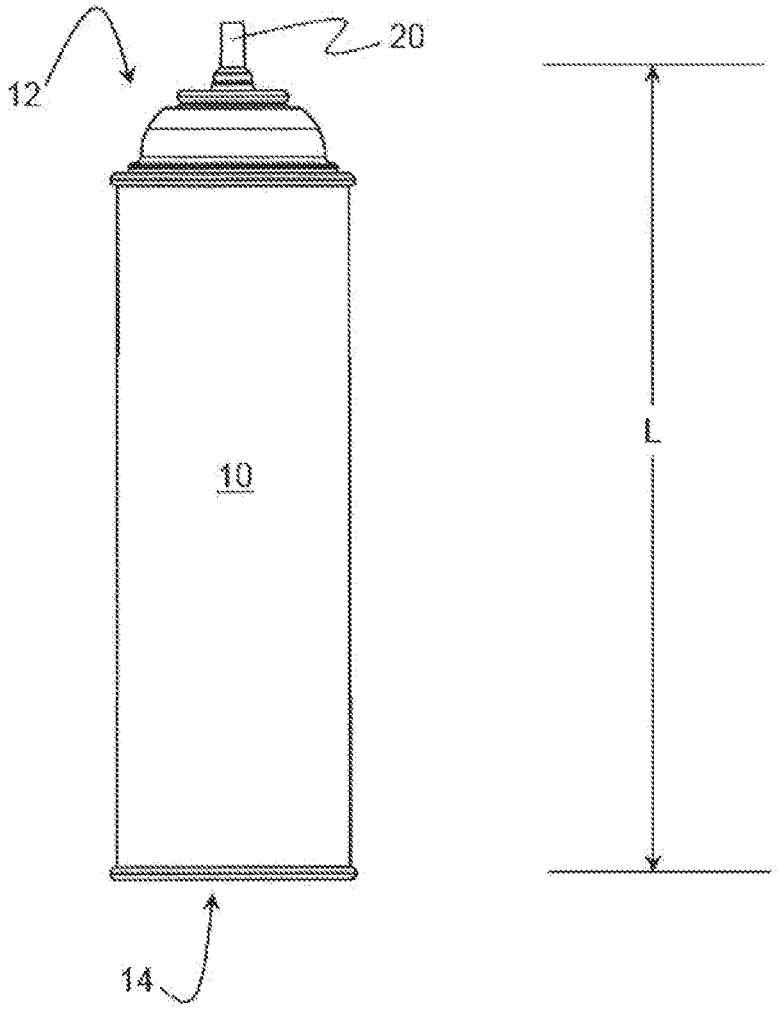
FIG. 1. A side view of a suitable can for use in the present invention.

"And/or" means "and, or alternatively". All ranges include endpoints unless otherwise stated. "Multiple" means more than one. "Fluid" refers to a substance that has no fixed shape and yields to external pressure and includes gas, liquid, and gas or liquid continuous formulations. Typically, though not necessarily, fluid refers to liquid and liquid continuous formulations.

"Proximate to" means "close to" and includes "located directly on". When stating "proximate to" a location having an opposing location, the positional relationship means closer to the stated location than the opposing location. For example, if an object is located proximate to end "A" of an article having opposing ends "A" and "B", in the broadest meaning the object is located closer to end "A" than end "B", and the object can be located directly on end "A".

The article of the present invention comprises a can, such as can 10 illustrated in FIG. 1. The can has opposing top (12) and bottom (14) ends. Generally, the can is cylindrical in shape. The can has length (L) with the top and bottom ends separated by the length of the can. A valve stem (20) extends out from the top end of the can. The can may be filled with fluid material and pressurized at which time when the valve stem is compressed, or tilted thereby compressing at least a portion of the valve stem, into the can the can is opened and the pressurized contents can exit the can through the valve stem.

Embodiments of the present invention are illustrated in FIGS. 2 and 3 and illustrate embodiments of the different elements of the dispensing device. In the broadest scope of the present invention, any embodiment of one element is combinable with any embodiment of any other element. The combinations in FIGS. 2 and 3 illustrate several different embodiments of each element and how they can combine to form embodiments of the present invention. Reference numbers below refer to FIGS. 2 and 3 for illustrations of embodiments of the specified elements. The elements and articles in the Figures are not meant to define the broadest scope of the elements or invention.

The present invention includes a dispensing device (100) attached to the can. The dispensing device allows a user to hold the can with the length of the can extending in an axial direction with respect to the forearm of the user of the can while dispensing contents of the can. Moreover, the dispensing device design allows a user to use a single hand, even a single finger, to simultaneously open the dispensing device and activate the valve stem to allow pressurized contents of the can to flow through the valve stem and the dispensing device for application onto a desired surface. Similarly, the dispensing device design allows a user to use a single hand, even a single finger, to simultaneously close and seal off the dispensing device and deactivate the valve stem to both stop flow of contents from the can and seal off the dispensing device so as to prevent drips. At the same time, the dispensing device provides protection for the valve stem of the can by covering the valve stem both when the article of the present invention is in use and when not in use yet the cap does not need to be removed to access the valve stem of the can to attach the dispensing device to the valve stem, thereby providing consistent protection of the valve stem during shipping, storing and use and eliminating a need to remove a cap when preparing to dispense contents of a can.

The dispensing device comprises a cap (30) attached to the can. The cap fits over the top end of the can and covers the valve stem. The cap defines an access slot (35) that allows access to the valve stem. The access slot is wide enough to allow a hollow tube (as described below) to extend through the access slot and tilt when attached to the valve stem. The access slot is desirably narrower than the width of the cap so as to allow the cap to protect the valve stem from accidental contact that might unintentionally dispense contents of the can. It is also desirable for the access slot to extend in length less than the full diameter of the cap to minimize the accessibility to the valve stem thereby further protecting the valve stem from accidental contact.

The dispensing device further comprises a hollow tube (40) with opposing entrance end (42) and exit end (44). The hollow tube defines a hollow tube flow channel (46) that extends all the way through the hollow tube including through the entrance end and through one or more than one hole (48) proximate to the exit end. FIG. 2 illustrates an embodiment of the present invention where there is a single hole (48) on the exit end of the hollow tube. FIG. 3 illustrates an embodiment of the present invention where there are multiple holes (48) proximate to but not directly on the exit end of the hollow tube. The present invention also includes embodiments where there are multiple holes defined on the exit end of the hollow tube as well as embodiments with a single hole proximate to but not directly on the exit end of the hollow tube.

The entrance end of the hollow tube removably attaches to the valve stem of the can so as to provide fluid communication through the valve stem and into the hollow tube flow channel. In the broadest scope, the hollow tube can attach to the valve stem in any conceivable way including frictionally fitting over the valve stem or having threading on the hollow tube extending into the hollow tube flow channel at the entrance end that mates with threading on the valve stem. "Removably attached" means capable of being repeatedly attached and removed. The hollow tube extends through the access slot in the cap.

The dispensing device further comprises a sleeve (50) with lower end (52) and opposing dispensing end (54). The sleeve is positioned so as to extend over at least a portion of the hollow tube and is able to reversibly slide over at least a portion of the hollow tube. The dispensing end of the sleeve is proximate to the exit end of the hollow tube. The sleeve defines a hole (56) through the sleeve proximate to, preferably on, the dispensing end.

The dispensing device comprises a lever (60) that has a sleeve end (62) and an opposing trigger end (64). The lever is hingedly connected to the cap between the sleeve and trigger ends. The trigger end of the lever extends along at least a portion of the length of the can and can extend at least half the length of the can. It is desirable for the trigger end of the lever to extend past the center of mass of the can so that an operator holding the can at its center of mass can easily grasp the trigger end of the lever.

The sleeve end of the lever is operatively engaged with the sleeve so as to cause the sleeve to slide over the hollow tube towards the exit end of the hollow tube when the trigger end of the lever is displaced towards the can. Operative engagement can be, in the broadest scope, any type of engagement that accomplishes the defined action. Examples of suitable forms of operatively engaging the sleeve end of the lever to the sleeve include: (a) hingedly attaching the lever to the sleeve; (b) fixedly attaching the lever to the sleeve (the sleeve and lever can be a single piece of material or attached with a rigid attachment); (c) positioning the sleeve end of the lever (or a portion thereof) on the entrance end side of a protrusion on the sleeve so that displacing the trigger end of the lever causes the sleeve end of the lever to push against the protrusion; and (d) positioning the sleeve end of the lever (or a portion thereof, such as one or more protrusion such as a pin-like protrusion) between protrusions on the sleeve (or in a groove defined in the sleeve with the sides of the groove acting in an equivalent way as protrusions) with one protrusion on the entrance end side of the sleeve end of the lever and another protrusion on the exit end side of the sleeve end of the lever so that displacing the trigger end of the lever causes the sleeve end of the lever to push against a protrusion on the sleeve.

The lever can be hingedly attached to the sleeve by, for example, positioning a hole or a slot in the lever around a protrusion extending out from the sleeve (or positioning holes or slots in the lever around protrusions extending out from the lever). Alternatively, as another example, positioning a hole or a slot in the sleeve around a protrusion extending out from the lever (or positioning holes or slots in the sleeve around protrusions extending out from the lever).

The lever can be fixedly attached to the sleeve by any conceivable method. For example, the lever and sleeve can be a single piece of material. As an alternative example, the lever can fit around the sleeve (preferably into a groove around the sleeve) so as to be rigidly attached to the sleeve.

The lever can be operatively attached to the sleeve by extending below a protrusion (or protrusions) in the sleeve. "Below" means more proximate to the can. In this regard, the sleeve end of the lever or a portion thereof can extend next to the sleeve and below one or more than one protrusion (for example, a ridge or ring of material) extending off from the sleeve. The lever can also define a hole through which the hollow tube and sleeve extend where the sleeve has one or more protrusion on its outside and above (less proximate to the can) the sleeve end of the lever that does not fit through the hole or slot.

The sleeve and lever can operatively engage by means of a protrusion of one fitting into a groove or between protrusions of the other. For example, pin-like protrusions on the sleeve end of the lever can fit into grooves defined on the sleeve as shown in FIG. 2.

The operative engagement of the lever with the sleeve causes the lever to both slide the sleeve towards the exit end of the hollow tube and causes the lever to tilt the valve stem with respect to the top of the can when the trigger end of the lever is displaced towards the can. As a result, with the single motion of displacing the trigger end of the lever towards the can an operator can both unseal the hole or holes (48) of the hollow tube and open the can by tilting the valve stem.

An elastic feature (70) applies a force, or causes a force to be applied, to the sleeve that tries to move the sleeve towards the entrance end of the hollow tube. For example, when the trigger end of the lever is displaced towards the can thereby causing the sleeve to move towards the exit end of the hollow tube, the force of the elastic feature is in a direction that tries to move the sleeve towards the entrance end of the hollow tube to restore the dispensing device into a closed position. The elastic feature, in the broadest scope of the present invention, can be any feature that provides the force described for the elastic feature. Examples of suitable elastic features include: (a) a spring with opposing ends and coiled around the hollow tube with one end connected to the sleeve and the opposing end connected to at least one of the can, the valve stem, the hollow tube (preferably below the sleeve, meaning on the can side of the lower end of the sleeve) and the cap; (b) a compressible elastic pad or spring (for example, coil spring, leaf spring, or a curved or looped band of elastic material) between the lever and at least one of the can and cap and positioned on the trigger end side of where the lever is hingedly attached to the can; (c) an elastic band or bands around one or more protrusion on the sleeve proximate to the lower end of the sleeve and one or more than one protrusion on the hollow tube on the can-side of the sleeve thereby elastically connecting the sleeve to the hollow tube proximate to the lower end of the sleeve; and (d) an elastic tether (such as a spring tether or other elastic connector) connecting the sleeve to the hollow tube proximate to the lower end of the hollow tube.

The elastic feature "applies a force to the sleeve" when the elastic feature contacts the sleeve directly and is either stretched or compressed. The elastic feature "causes a force to be applied to the sleeve" when the elastic feature does not directly contact the sleeve but rather directly contacts another element such as the lever that either directly or indirectly contacts the sleeve so that when a force is applied to the other element the force is translated to the sleeve. For example, when the elastic element is a spring between the can and lever, then displacement of the trigger portion of the lever towards the can compresses the elastic element which in turn applies a force on the trigger end of the lever, which in turn applies a force to the sleeve through its operative engagement with the sleeve. That is, the elastic element applies a force on the trigger end of the lever pushing the trigger end of the lever away from the can and when the trigger end of the lever moves away from the can the sleeve end of the lever applies a force to the sleeve drawing the sleeve towards the entrance of the hollow tube (to a closed position).

The dispensing device can reversibly move between an open position and a closed position by sliding the sleeve along the hollow tube. When the dispensing device is in a closed position, the sleeve (which can mean only a portion of the sleeve) seals all of the one or more than one hole proximate to the exit end of the hollow tube thereby preventing fluid communication from inside the hollow tube (that is, from the hollow tube flow channel) through any of the one or more than one holes to outside of the hollow tube. When the dispensing device is in an open position the sleeve does not seal one or more than one of the holes proximate to the exit end of the hollow tube thereby allowing fluid communication from inside the hollow tube to outside the hollow tube through one or more than one of the holes proximate to the exit end of the hollow tube. When the dispensing device is in a closed position, sliding the sleeve along the hollow tube towards the exit end of the hollow tube causes the sleeve to unseal the hole or holes proximate to the exit end of the hollow tube, and thereby corresponds to moving the dispensing device into an open position. When the dispensing device is in an open position, sliding the sleeve along the hollow tube towards the hollow base causes the sleeve to seal the hole or holes proximate to the exit end of the hollow tube thereby corresponding to positioning the dispensing device into a closed position. When the dispensing device is in a closed position, the sleeve is considered in a closed position and vice versa. Likewise, when the dispensing device is in an open position, the sleeve is considered in an open position and vice versa.

The trigger end of the lever extends along the length of the can but is spaced apart from the can when the dispensing device is in a closed position. The trigger end of the lever arm can be displaced towards the can to move the sleeve towards the exit end of the hollow tube and cause the dispensing device to move into an open position.

A beneficial feature of the present invention is that an operator can hold the can proximate to its center of gravity and, with a single action, unseal the hollow tube and tilt the valve stem of the can to cause flow of can contents through the dispensing device by displacing the trigger end of the lever towards the can. Moreover, the operator can subsequently seal the hollow tube and allow the valve stem to return to a close position by releasing pressure on the trigger end of the lever and allowing the elastic feature to move the sleeve to a closed position. Hence, both unsealing the hollow tube and dispensing from the can as well as subsequent sealing of the hollow tube and closing of the can may be accomplished with a single action while holding the can proximate to its center of gravity.

The hollow tube can be of uniform outside diameter or, preferably, tapers to a smaller outside diameter proximate to the exit end of the hollow tube. Similarly, the portion of the sleeve that extends over the hollow tube proximate to the exit end of the hollow tube can be uniform in inside diameter. Alternatively, if the hollow tube tapers to a smaller outside diameter proximate to the exit end of the hollow tube the portion of the sleeve that extends over the hollow tube proximate to the exit end of the hollow tube also can taper to a smaller inside diameter proximate to the exit end of the hollow tube—preferably so that the outside of the tapered end of the hollow tube fits against the inside of the sleeve when the dispensing device is in a closed position.

The hollow tube and/or sleeve can independently be single pieces or comprise multiple pieces attached together. For example, when the hollow tube has a tapered end it can be advantageous to prepare a tapered tip section separate from a first section that comprises the rest of the hollow tube where the first section includes the entrance end of the hollow tube and the tip section includes the exit end of the hollow tube as well as the one or more hole proximate to the exit end of the hollow tube. The tip section can attach to the first section of the hollow tube so that the tapered tip comprises the tapered end of the hollow tube. Separate pieces can attach to one another by any means. For example, the pieces can comprise mating ring and grooves where a ring (or other protrusion) of one piece snaps into mating configuration with a groove (or other depression or hole) in another piece.

In the broadest scope of the invention, the sleeve can seal the hole or holes proximate to the end of the hollow tube when the dispensing device is closed by any conceivable means. For example, the sleeve can define protrusions that slide into the hole or holes of the hollow tube when the dispensing device is placed into a closed position but slide out from the hole or holes when the dispensing device is moved into an open position. FIG. 2 illustrates a version of this embodiment where sleeve 50 comprises protrusion 500 extending inwards towards hollow tube 40, which defines hole 48 on the exit end. When the dispensing device is closed, protrusion 500 presses against or into hole 48 so as to seal hole 48 to preclude fluid communication from the hollow tube flow channel through hole 48. When the dispensing device is in an open position, protrusion 500 is apart from hole 48 so as to allow fluid flow from the flow channel of the hollow tube through hole 48.

When the one or more than one hole 48 is proximate to, but not on the exit end of the hollow tube then there are additional configurations possible for precluding fluid flow when the dispensing device is in the closed position. For instance, the closed exit end of the hollow tube can press against the sleeve so as to form a seal around the hollow tube that precludes fluid flow between the hollow tube and sleeve from the one or multiple holes out from the dispensing end of the sleeve. At the same time, a gasket may preclude fluid flow between the hollow tube and sleeve towards the entrance end of the hollow tube. This is the situation in the configuration of FIG. 3, which illustrates a dispensing device in the closed position with exit end 44 of hollow tube 40 sealing against sleeve 50 and holes 48 residing between where the exit end 44 seals against sleeve 50 and sealing gasket 80. In FIG. 3, both the inside diameter of the sleeve and the outside diameter of the hollow tube taper to smaller diameters proximate to the dispensing and exit ends respectively. When in the open position the sleeve is displaced from the closed exit end of the hollow tube thereby allowing fluid flow from the one or multiple holes in the hollow tube proximate to the exit end and out from the dispensing end of the sleeve. Additionally, or alternatively, the sleeve can press against the hollow tube around hole or holes 48, and/or extend protrusion into holes 48, so as to directly seal the one more than one hole proximate to the entrance end of the hollow tube when closed. The sleeve can then offset from the one or multiple holes when in an open position. In either of these configurations, it is desirable for the hollow tube to taper to a narrower outer diameter proximate to the exit end of the hollow tube and for the sleeve to taper to a narrower inner diameter proximate to the dispensing end of the sleeve. The tapered shape facilitates sealing of the dispensing device in the closed position as the hollow tube resides in a narrowed inner diameter of the sleeve, but in the open position the exit end of the hollow tube resides in a larger inner diameter of the sleeve thereby facilitating flow from the one or more than one hole in the hollow tube, around the exit end of the hollow tube and out through the dispensing end of the sleeve.

Sealing gasket 80 resides around the outside of the hollow tube between the hollow tube and sleeve so that the gasket contacts both the hollow tube and sleeve so as to prevent fluid flow past the gasket between the hollow tube and sleeve. Desirably, the sealing gasket extends all the way around the hollow tube. Sealing gasket 80 is located between the hole or holes 48 and the entrance end 42 of the hollow tube, preferably proximate to the hole or holes 48. The sealing gasket contacts both the wall of the hollow tube and the sleeve in a manner that prevents fluid flow past the sealing gasket along the outside of the hollow tube between the hollow tube and the sleeve. The sealing gasket acts as a barrier preventing fluid from traveling between the hollow tube and sleeve past the sealing gasket and instead forces the fluid to exit the dispensing end of the sleeve. The sealing gasket desirably wraps all the way around the outside of the hollow tube (for example, a ring of material around the hollow tube). The sealing gasket can be attached to or part of (that is, integral with) either the outside of the wall of the hollow tube or the inside of the sleeve. Conceivably, the sealing gasket can be attached to neither the hollow tube nor sleeve but rather frictionally held between the hollow tube and sleeve—such as an "o-ring" of elastic, or elastomeric or rubber material that is slid over the hollow tube and then the sleeve is slid over the o-ring. Optionally, the sealing gasket can reside in a groove in the sleeve or hollow tube. The sealing gasket can be a rigid material such as a rigid plastic, but is preferably an elastic, or elastomeric or rubber material that contacts one or both of the hollow tube and sleeve so that the sealing gasket can conform to both the hollow tube and sleeve to form a fluid impervious seal even as the sleeve slides along the hollow tube between open and closed positions. Examples of suitable sealing gasket materials include rubber materials such as nitriles and ethylene propylene diene monomer rubber (EPDM).

It is desirable for the hollow tube to extend co-linearly with respect to the valve stem of the can when attached to the valve stem and when in a closed position. In such a configuration, the article of the present invention is readily operable in one hand in an axial direction with respect to the forearm of the hand thereby allowing access to difficult to reach locations, those locations that require a long reach to access and to make dispensing more comfortable and less fatiguing to a user.

FIG. 2 illustrates a form of the present invention where the elastic connector (70) is a spring with opposing ends and coiled around hollow tube 40. One of the ends of the spring is connected to the lower end 52 of sleeve 50 and the opposing end of the spring is attached to the hollow tube below the sleeve. When the sleeve slides along the hollow tube away from the can to position the dispensing device into an open position the spring applies a restoring force drawing the sleeve back towards the can. FIG. 2 also illustrates lever 60 operatively attached to sleeve 50 by a method where the lever extends on either side of the sleeve and defines pin-like protrusions (61) that extend towards the sleeve and into a groove between ridges (51) defined on the outside of the sleeve.

FIG. 3 illustrates a form of the present invention where elastic connector 70 is an elastic spring in the form of a curved band of elastic material between the can and the lever on the trigger end side of where the lever is hingedly attached to the can. FIG. 3 also illustrates lever 60 rigidly connected to sleeve 50 by snapping around the sleeve with a semicircular protrusion of the lever extending into a groove around the sleeve.

The dispensing device can comprise or be free of a position indicator that provides a visual indication of whether the dispensing device is in an open position or a closed position. One example of a position indicator is a hole in the side of the sleeve proximate to the dispensing end that reveals a portion of the hollow tube and wherein the portion of hollow tube evident through the hole when the dispensing device is closed is one color, and when open is another color.

The invention claimed is:

1. An article comprising a can (10) and a dispensing device (100) wherein the can has opposing top (12) and bottom (14) ends with a valve stem (20) extending out from the top end and wherein the dispensing device comprises:

(a) a cap (30) attached to the can and that fits over the top end of the can and covers the valve stem where the cap has defined therein an access slot (35) that provides access to the valve stem;

(b) a hollow tube (40) having opposing entrance (42) and exit (44) ends and that defines a hollow tube flow channel (46) extending through the hollow tube including the entrance end and one or more than one hole (48) proximate to the exit end, the entrance end of the hollow tube being removably attached to the valve stem of the can so that there is fluid communication through the valve stem into the flow channel and the hollow tube extending through the access slot in the cap;

(c) a sleeve (50) extending over a portion of the hollow tube, the sleeve having a lower end (52) and an opposing dispensing end (54) that is proximate to the exit end of the hollow tube where the sleeve defines a hole proximate to the dispensing end and the sleeve is capable of reversibly sliding over the hollow tube;

(d) a lever (60) that has a sleeve end (62) and an opposing trigger end (64) that is hingedly attached to the cap between the sleeve and trigger ends, where the sleeve end is operatively engaged with the sleeve so as to cause the sleeve to move towards the exit end of the hollow tube and tilt the valve stem of the can when the trigger end of the lever is displaced towards the can and where the trigger end extends along at least a portion of the length of the can;

(e) an elastic feature (70) that provides a force, or causes a force to be applied, to the sleeve when the sleeve is moved towards the exit end of the hollow tube, the force being in a direction that tries to move the sleeve towards the entrance end of the hollow tube; and (f) a sealing gasket (80) around the outside of the hollow tube between the hollow tube and the sleeve and located between the exit and entrance ends of the hollow tube, the sealing gasket preventing fluid communication past the sealing gasket between the hollow tube and sleeve;

wherein, when the sleeve is in a closed position the sleeve seals the hole proximate to the exit end of the hollow tube so as to preclude fluid flow out from the flow channel of the hollow tube proximate to the exit end of the hollow tube and the trigger end of the lever extends next to but spaced apart from the can, but when the sleeve is in the open position the sleeve is displaced towards the exit end of the hollow tube unsealing the hole proximate to the exit end of the hollow tube thereby allowing fluid flow from the flow channel of the hollow tube through the hole proximate to the exit end of the hollow tube; and wherein with a single action of pressing the lever so as to displace the trigger end of the lever towards the can when the sleeve is in a closed position causes the sleeve to move into an open position and the valve stem to tilt thereby opening the can, and with a single action of releasing pressure on the trigger end of the lever the sleeve moves into a closed position sealing the hollow tube and the valve stem returns to a non-tilted position closing the can.

2. The article of claim 1, wherein the elastic feature is selected from a group consisting of:

i. a spring with opposing ends and coiled around the hollow tube with one end connected to the sleeve and the opposing end connected to at least one of the can, the valve stem, the hollow tube and the cap;

ii. a compressible elastic pad or spring between the lever and at least one of the can and cap and positioned on the trigger end side of where the lever is hingedly attached to the can;

iii. an elastic band or bands around one or more protrusion on the sleeve proximate to the lower end of the sleeve and one or more than one protrusion on the hollow tube on the can-side of the sleeve thereby elastically connecting the sleeve to the hollow tube proximate to the lower end of the sleeve; and iv. an elastic tether connecting the sleeve to the hollow tube proximate to the lower end of the hollow tube.

3. The article of claim 1, wherein the trigger end of the lever mechanism extends along at least half the length of the can.

4. The article of claim 1, wherein the hollow tube tapers to a smaller outside diameter proximate to the exit end of the hollow tube, and the portion of the sleeve that extends over the hollow tube proximate to the exit end of the hollow tube also tapers to a smaller inside diameter proximate to the exit end of the hollow tube.

5. The article of claim 1, wherein the hollow tube has a hole on its exit end and the sleeve has a protrusion (500) extending inwards towards the hollow tube at the sleeve's dispensing end and positioned such that when the dispensing device is in a closed position the protrusion seals the hole on the exit end of the hollow tube thereby preventing fluid flow out from the hole on the exit end of the hollow tube, and when the dispensing device is in an open position the protrusion is remote from the hole and fluid can flow out from the hole on the exit end of the hollow tube.

6. The article of claim 1, wherein the hollow tube has a tapered hollow tube section that narrows in outside diameter proximate to the exit end of the hollow tube and has defined through the tapered hollow tube section a hole proximate to but not on the exit end and wherein the sleeve has a tapered sleeve section that narrows in inside diameter proximate to the dispensing end such that the exit end of the hollow tube presses against the sleeve so as to form a seal around the hollow tube that precludes fluid flow between the hollow tube and sleeve from the hole proximate to the exit end of the hollow tube and out from the dispensing end of the sleeve when the sleeve is in a closed position, but the exit end of the hollow tube displaces from the sleeve to allow fluid flow from the hole proximate to the exit end of the hollow tube and out through the dispensing end of the sleeve when the sleeve is in an open position.

7. The article of claim 1, wherein the hollow tube, the sleeve, or both the hollow tube and sleeve comprise multiple pieces attached together.

8. The article of claim 1, wherein the hollow tube extends collinearly with the valve stem of the can when the dispensing device is in the closed position.

* * * * *